US006698440B2

(12) United States Patent
Beyer et al.

(10) Patent No.: US 6,698,440 B2
(45) Date of Patent: Mar. 2, 2004

(54) UMBRELLA WITH CHAMBER AND TRANSPORT FOR A CANOPEUM

(76) Inventors: Andrea Elgin Beyer, 112 Delafield Ave., Staten Island, NY (US) 10301-2606; Steven Larsen Beyer, 112 Delafield Ave., Staten Island, NY (US) 10301-2606

( * ) Notice: Subject to any disclaimer, the term of this patent is extended or adjusted under 35 U.S.C. 154(b) by 0 days.

(21) Appl. No.: 09/784,253

(22) Filed: Feb. 15, 2001

(65) Prior Publication Data

US 2002/0108645 A1 Aug. 15, 2002

(51) Int. Cl.[7] ..... A45B 19/00
(52) U.S. Cl. ..... 135/25.41; 135/98; 135/913
(58) Field of Search ..... 135/98, 99, 127, 135/124, 126, 25.41, 34.2, 16, 18, 20.3, 15.1, 19.5, 913

(56) References Cited

U.S. PATENT DOCUMENTS

| | | | | | |
|---|---|---|---|---|---|
| 144,792 | A | | 11/1873 | Prentiss | |
| 2,183,833 | A | * | 12/1939 | Farhar | 135/20.3 |
| 2,502,984 | A | | 4/1950 | Parmenter | |
| 2,546,228 | A | | 3/1951 | Martini | |
| 2,661,752 | A | | 10/1952 | Kampf et al. | |
| 3,477,453 | A | | 11/1969 | D'Ulisse | |
| 3,621,857 | A | | 11/1971 | May et al. | |
| 3,706,160 | A | * | 12/1972 | Deibert | 47/23.2 |
| 3,709,238 | A | * | 1/1973 | Leopoldi et al. | 135/15.1 |
| 3,844,301 | A | * | 10/1974 | Harrell | 135/15.1 |
| 3,860,022 | A | | 1/1975 | Arndt et al. | |
| 3,889,698 | A | * | 6/1975 | Roessl | 135/94 |
| 4,022,233 | A | | 5/1977 | Grundman | |
| 4,086,931 | A | | 5/1978 | Hall | |
| 4,202,363 | A | | 5/1980 | Watts et al. | |
| 4,422,468 | A | * | 12/1983 | Wilson | 135/97 |
| 4,621,653 | A | * | 11/1986 | Aquino | 135/151 |
| 5,172,712 | A | * | 12/1992 | Robinson | 135/98 |
| 5,188,137 | A | * | 2/1993 | Simonelli | 135/19.5 |
| D352,759 | S | | 11/1994 | Cantwell | |
| 5,664,595 | A | | 9/1997 | Vonderhorst et al. | |
| 5,678,587 | A | * | 10/1997 | Bilotti | 135/98 |
| 5,690,131 | A | * | 11/1997 | Voigt | 135/19.5 |
| 5,740,822 | A | * | 4/1998 | Einck | 135/16 |
| 5,806,547 | A | * | 9/1998 | Derlinga | 135/33.2 |
| 6,009,891 | A | | 1/2000 | Surface et al. | |
| 6,155,278 | A | | 12/2000 | Lin | |
| 6,273,111 | B1 | * | 8/2001 | Weiss et al. | 135/25.41 |

* cited by examiner

*Primary Examiner*—Janet M. Wilkens

(57) ABSTRACT

An umbrella with a chamber for storage of material such as an enclosure canopeum of netting. Included are mechanisms for transport and interchange of various canopeums. By turning a crank handle, netting is transported from its storage chamber to the edge of the umbrella canopy, where it can be lowered to the ground. The canopeum will then shield those under the umbrella from incursions by agents such as insect pests. Turning the crank in the opposite direction transports the canopeum to its stowed and protected position within the chamber. Canopeum accouterments facilitate attachment, removal, and interchange of canopeums having varied compositions, textures, and surface details.

17 Claims, 5 Drawing Sheets

UMBRELLA WITH CHAMBER AND TRANSPORT FOR A CANOPEUM

BACKGROUND OF THE INVENTION

The present invention relates to an umbrella, tent, or canopy, specifically to an umbrella with a storage chamber for an enclosure canopeum of netting, and having mechanisms for canopeum deployment, retraction, and interchange.

REFERENCES TO RELATED ART

Devices such as umbrellas, canopies, and tents are widely used outdoors. They are familiar features of gardens, yards, patios, restaurants, beaches, pools and parks. These devices interdict unwanted environmental agents approaching from above. Excessive sunlight, rain, and falling debris are blocked. Outdoor living is enhanced by protection from such intrusions. However, umbrellas usually lack protective barriers effective beyond the edge of their canopies. This allows vulnerability to invasion by pests such as mosquitoes, flies, and bees.

Therefore, inventors have proposed protective enclosures for temporary outdoor structures. Additionally, some inventors have proposed mechanisms to extend and retract umbrella enclosures.

FOR EXAMPLE, U.S. Pat. No. 144,792, November 1873, to Prentiss describes a portable combination of umbrella and netting. The net material is attached to the periphery of the umbrella's canopy.

This enclosure is long enough to reach the ground.

FOR EXAMPLE, U.S. Pat. No. 2,502,984, April 1950, to Parmenter describes an umbrella said to provide enhanced, adjustable protection from the elements.

FOR EXAMPLE, U.S. Pat. No. 2,546,228, March 1951, to Martini describes a transparent shield suspended from an umbrella.

FOR EXAMPLE, U.S. Pat. No. 2,661,752, December 1953, to Kampf et al. describes a "garden" type umbrella with a hollow support. The support contains a cord used to manipulate the umbrella's canopy. One end of the cord is attached to a runner on the support. The cord's other end, after passing through a pulley, is connected to a manually operated reel.

FOR EXAMPLE, U.S. Pat. No. 3,477,453, November 1969, to D'Ulisse and D'Ulisse describes a net for converting an umbrella to a shelter from insects. It consists of a dome-shaped net covering for beach-type umbrellas, adapted to rest on the roof of the umbrella. It possessing sidewalls that extend to the ground. A hole is provided in the center of the covering to permit the umbrella support pole to protrude. Loops are provided at the bottom, perimeter of the wall for use staking the wall to the ground. Devices are provided on the dome for securing it to the umbrella.

FOR EXAMPLE, U.S. Pat. No. 3,621,857, November, 1971, to May et al. describes a tent fly supported by a structure that keeps the fly taut. It also separates the fly from the top of the tent. The fly contains parts of the canopy, overhanging the edge of the tent. Methods are also provided to adjust the canopy and to facilitate its deployment.

FOR EXAMPLE, U.S. Pat. No. 3,860,022, January 1975, to Arndt et al. describes a umbrella-like structure with sides of netting. These sides drape down and outward, secured to the ground with stakes.

FOR EXAMPLE, U.S. Pat. No. 4,022,233, May 1977, to Grundman describes an umbrella with an attached retractable protective material.

FOR EXAMPLE, U.S. Pat. No. 4,086,931, May 1978, to Hall describes an umbrella whose support is located off-center, at the side of its canopy. The space under the umbrella is enclosed by means of segments of fabric suspended from its periphery.

FOR EXAMPLE, U.S. Pat. No. 4,202,363, May 1980, to Watts et al. describes a collapsible, combination umbrella and tent. The support frame is attached to two central hubs mounted on a central pole. Movement of these hubs facilitate erection and collapsing of the structure and its covering.

FOR EXAMPLE, U.S. Pat. No. 4,422,468, December 1983, to Wilson describes a lawn type umbrella. It has an enlarged canopy and central pole cover that expands to provide increased covering.

FOR EXAMPLE, U.S. Pat. No. 5,172,712, December 1992, to Robinson describes a combination beach umbrella and screen apparatus. It includes a flexible, detachable, screen attached around the perimeter of the canopy of the umbrella. The screen is designed to provide additional shade and protection from insects, and inclement weather.

FOR EXAMPLE, U.S. Pat. No. Des. 352,759, November 1994, to Cantwell describes a screen tent house having slanted walls extending from a central canopy.

FOR EXAMPLE, U.S. Pat. No. 5,664,595, September 1997, to Vonderhorst, et al. describes a removable screen apparatus, that may be mounted atop an umbrella. It promises transportable personal protection from flying insects.

FOR EXAMPLE, U.S. Pat. No. 5,678,587, October 1997, to Bilotti describes an umbrella net that provides a drawstring for adjusting the height of the umbrella's net wall. It also offers a method for withdrawing the wall into a sleeve-like storage space located under the peripheral edge of the umbrella.

FOR EXAMPLE, U.S. Pat. No. 5,740,822, April 1998, to Einck describes a patio set including an umbrella. A skirt extends down from the umbrella's canopy. The skirt is moveable, relative to the canopy. It is retracted when the canopy is raised, and extended when the canopy is lowered. In both raised and lowered situations the canopy is itself extended. The raised canopy is for when chairs and table are in use. The lowered location of the canopy protects chairs and table, when they are unoccupied. The skirt is moved between by a set of flexible members connected to the lower end of the skirt. Movement of the flexible members, such as cords, can be accomplished in a variety of ways such as rack and pinion, pneumatic cylinder, hydraulic cylinder, or by motor.

FOR EXAMPLE, U.S. Pat. No. 5,806,547, September 1998, to Derlinga describes a combination umbrella and gazebo. Walls dropped from the canopy of the umbrella define the structure as a gazebo. A stepped sequence of cords is attached at one end to a crank. The cords provide a way to raise and lower the sides.

FOR EXAMPLE, U.S. Pat. No. 6,009,891, January 2000, to Surface, Decker, and Fanti describes a screen enclosure system providing a tether system attachable to the umbrella and shaped to form an exoskeleton over the umbrella. The skeleton is made by attaching many individual tethers to the umbrella over the spines of the umbrella. Also provided is a screening system attached to the exoskeleton by fasteners.

FOR EXAMPLE, U.S. Pat. No. 6,155,278, December 2000, to Lin describes an umbrella with a series of overlapping canopies designed to provide ventilation as well as protection.

REFERENCES TO SPECIFIC PROBLEMS OF RELATED ART

Devices referenced above have a number of disadvantages. Protective enclosures temporarily mounted on umbrellas, such as described by U.S. Pat. No. 3,477,453, D'Ulisse and D'Ulisse, November 1969, require considerable time and effort to attach and remove. These are procedures that can excessively challenge many individuals' strength and manual dexterity. Most people apparently shun the demands of such enclosures.

During periods while removed from the umbrella, enclosures benefit from storage. This avoids damage from destructive agents such as bird droppings, air-borne dirt, and tear inflicting objects. Umbrella enclosures therefore benefit from placement in storage containers, when not in active service.

To avoid problems described above, various solutions have been proposed. Mechanisms that extend and retract enclosures permanently attached to umbrellas may be seen in prior art. Examples include disclosures such as U.S. Pat. No. 5,678,587, Bilotti, October 1997, and U.S. Pat. No. 5,806,547, Derlinga, September 1998. However these devices have significant limitations.

Bilotti suggested stowing retracted netting around an umbrella's canopy. However, material gathered at the tips of umbrella ribs inevitably droops. A series of catenary shaped segments then adorns the umbrella canopy. Some may view these hangings as cumbersome protuberances, unsightly and physically intrusive. Such configurations also act as catch basins for airborne debris.

Recognizing these problems, in U.S. Pat. No. 5,806,547, September 1998, Derlinga proposed folding sheaths, extensions of the canopy, that wrap around canopy suspended netting. However, opening and closing such sheaths is time consuming, and also may be physically taxing for some individuals.

Inventors have, for well over a century, recognized advantages of adding enclosures such as netting to umbrellas. However, the prior art shows no adequate solution to the inherent problems indicated above. Past attempts at providing effective, convenient deployment, retraction, and storage of umbrella enclosures have not been successful.

BRIEF SUMMARY OF THE PRESENT INVENTION

Objects and Advantages

Accordingly, beside the objects and advantages of the enclosures described in our above patent, several objects and advantages of the present invention are:

(a) to provide an outdoor structure with a storage chamber ("chamber") for enclosing material such as netting. The chamber can contain a canopeum of the enclosure material ("canopeum") when the material is not in use. The word canopeum describes an enclosure of material that protects occupants against intrusions by insects and other unwelcome agents. Canopy is the term used to indicate a standard umbrella covering.

(b) to provide a transport system for moving the canopeum between the chamber and the enclosure's operational positions (c) to provide ways for attachment, removal, and interchange of canopeums having assorted compositions, textures, and details (d) to provide modifications to standard umbrella structures, insuring cooperation with the present invention Further objects and advantages of the present invention include the following. The invention encourages use of a canopeum that is convenient to store, deploy, and retract. The invention's storage chamber and deployment system is both simple to use and cost effective to manufacture. These factors support the invention's availability to prevent annoyance, and possible disease, from insect pests.

BRIEF DESCRIPTION OF THE SEVERAL VIEWS OF THE DRAWING

These and other features, and advantages of the present invention will become apparent from the following descriptions and drawings. Like reference numerals represent like elements in the several views, and in which.

Sheet 1/5

Sheet 2/5

Figure 3:
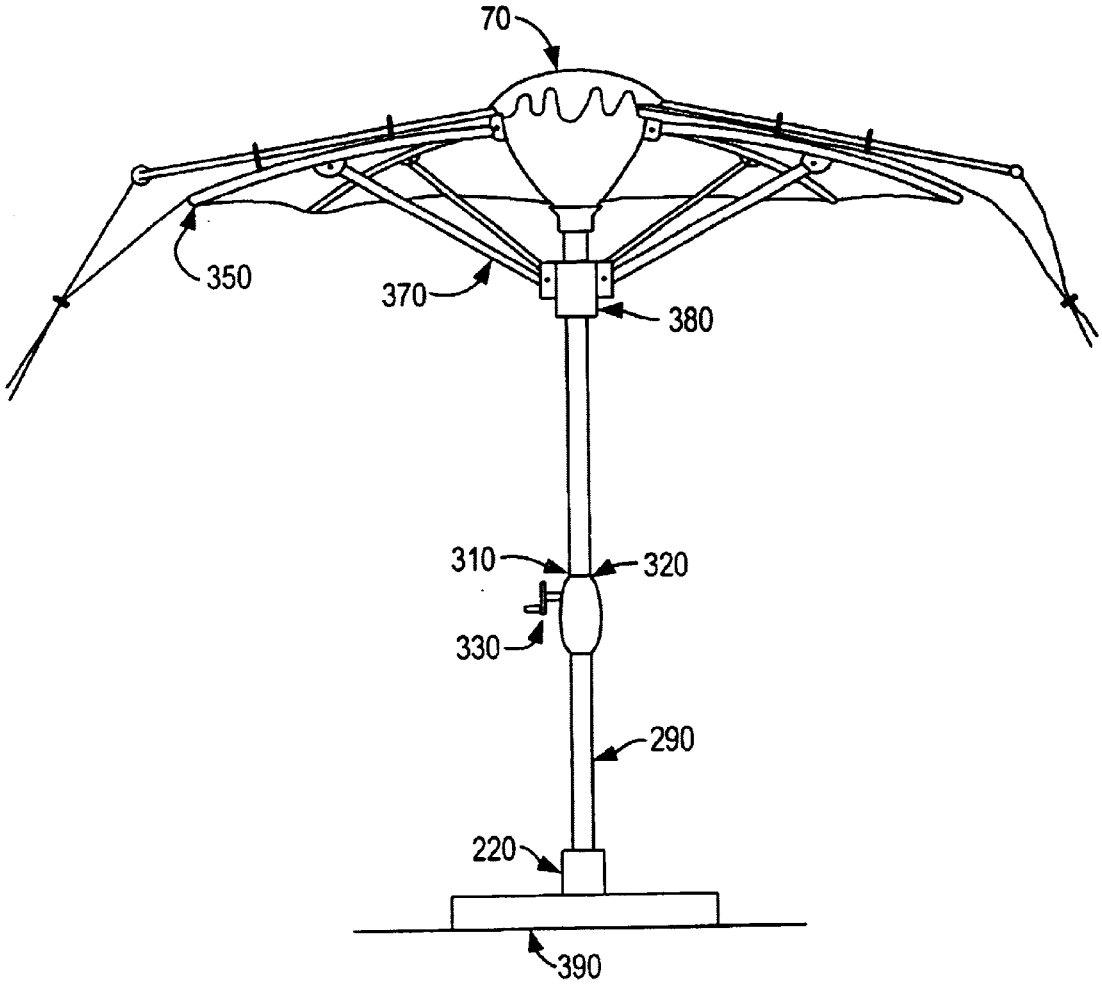

FIG. 3 is a section showing the umbrella canopy open and the canopeum deployed.

Sheet 3/5

Figure 4:
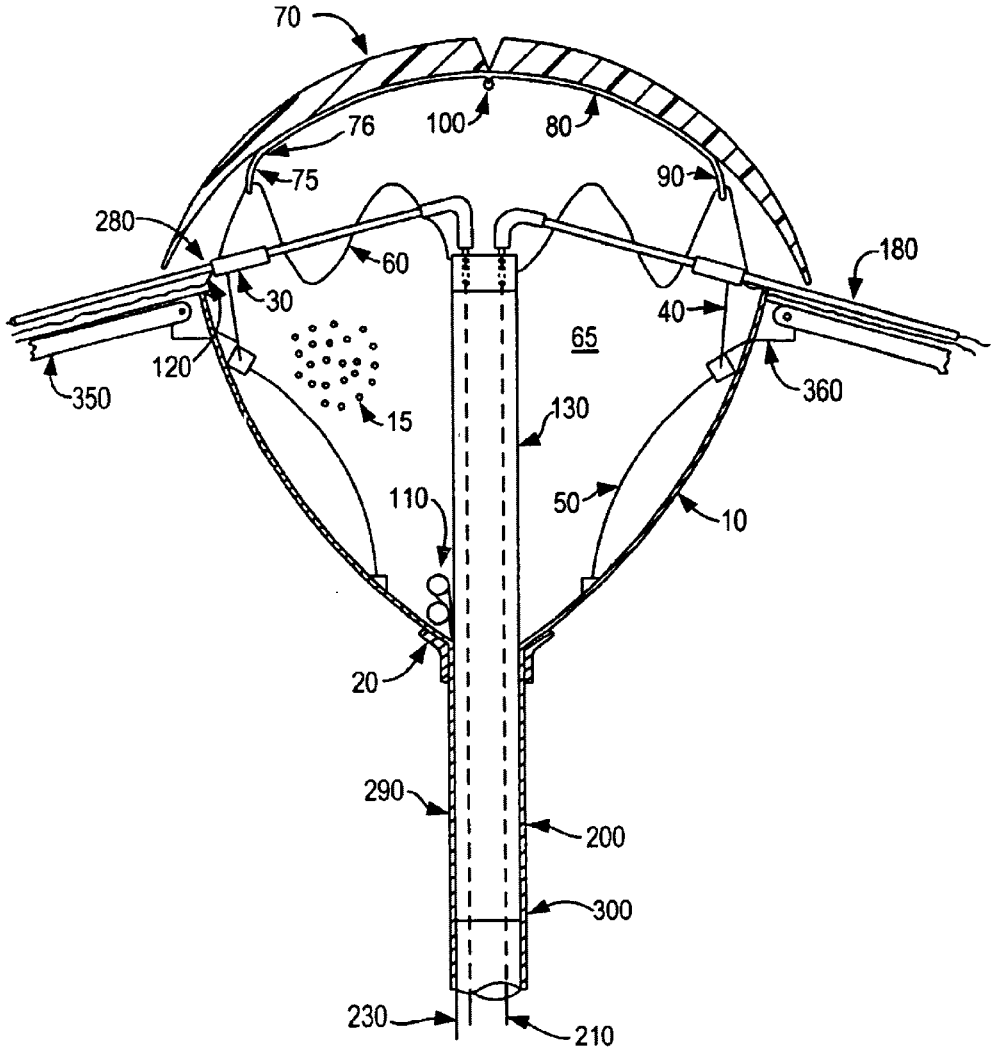

FIG. 4 is an elevation of the upper portion of the umbrella, showing its chamber, with transport system extended.

Sheet 4/5

Figure 5:
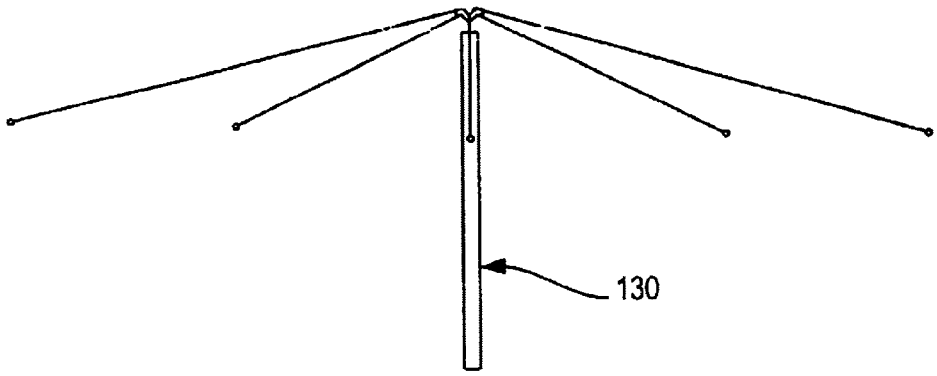

FIG. 5 is an elevation of the transport cylinder with transport tubes in fully deployed configuration.

Figure 6:
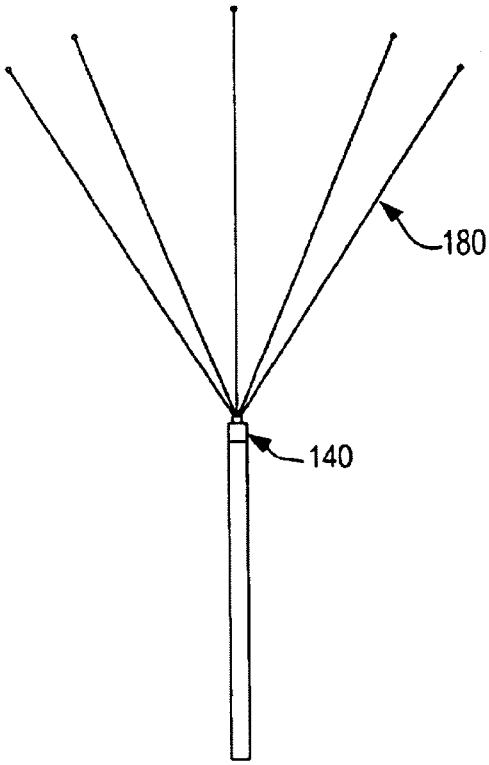

FIG. 6 is an elevation of transport cylinder and transport tubes in partially deployed positions.

Figure 7:
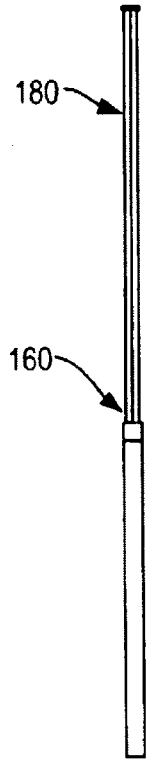

FIG. 7 is an elevation of transport cylinder and transport tubes in their fully retracted configuration.

Sheet 5/5

Figure 8:
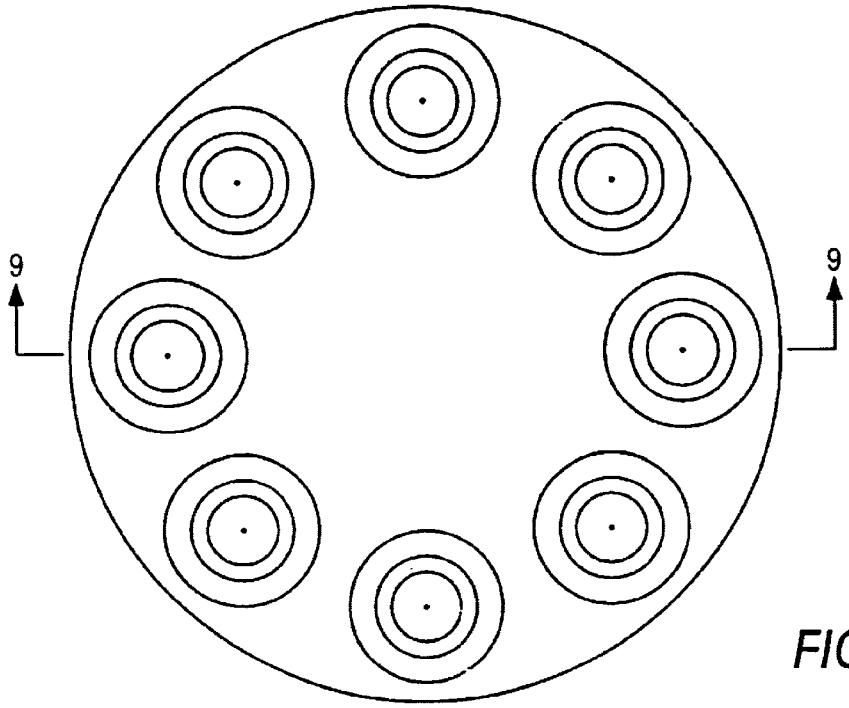

FIG. 8 is an enlarged sectional view of the invention including upper transport cylinder, flexible connector tubes containing stents, and adjacent ends of transport tubes.

Figure 9:
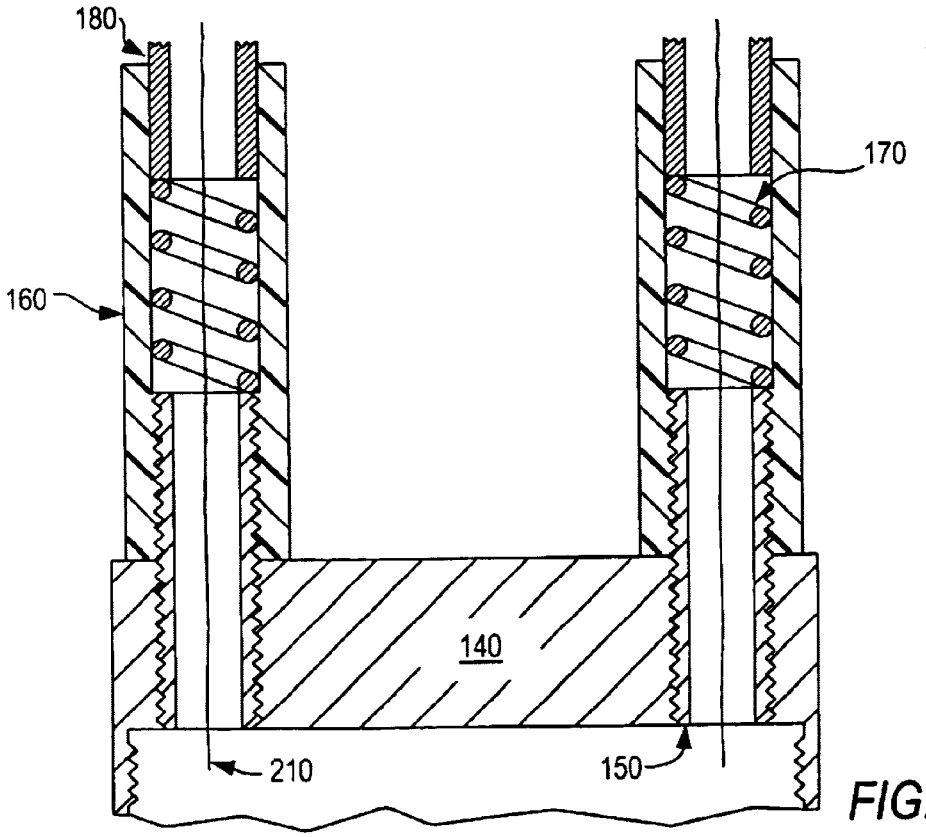

FIG. 9 is an elevation section of FIG. 8.

LIST OF REFERENCE NUMERALS UTILIZED IN THE DRAWING

10 chamber
15 chamber perforations
20 chamber support transition piece
30 alignment guide
40 guide linkage
50 linkage track
60 crown
65 septum
70 cover
72 cover flexible union
75 cover clip
76 cover clip anchor
80 cover support frame
90 cover support anchors
100 cover support
110 deployer cord pulleys
120 chamber sites for attachment of canopeum
130 transport cylinder
140 transport cylinder attachment
150 attachment tubes
160 flexible plastic tube
170 steel spring stiffener
180 transport tube
190 safety tip
200 transport cylinder key
210 retractor string

220 retractor string pulley
230 deployment cord
240 canopeum
245 canopeum zipper
250 canopeum base ring
255 ground fasteners
260 canopeum wall ring
270 canopeum transport tube ring
280 canopeum chamber fasteners
290 support
300 support keyway
310 retractor string access port
320 deployment cord access port
330 crank, gear, reel assembly
340 canopy
350 canopy rib
360 rib pivot
370 rib support
380 rib slide collar
390 umbrella stand

Detailed Description of the Invention
Umbrella with Chamber and Transport for a Canopeum

Description of Components

The present invention is distinct from configurations and mechanisms seen in prior art. Our enclosure storage and deployment system is unique in the field of umbrella, tent, and canopy construction and usage. The essence of this distinction may be seen in a typical embodiment of the invention.

Figure 1:
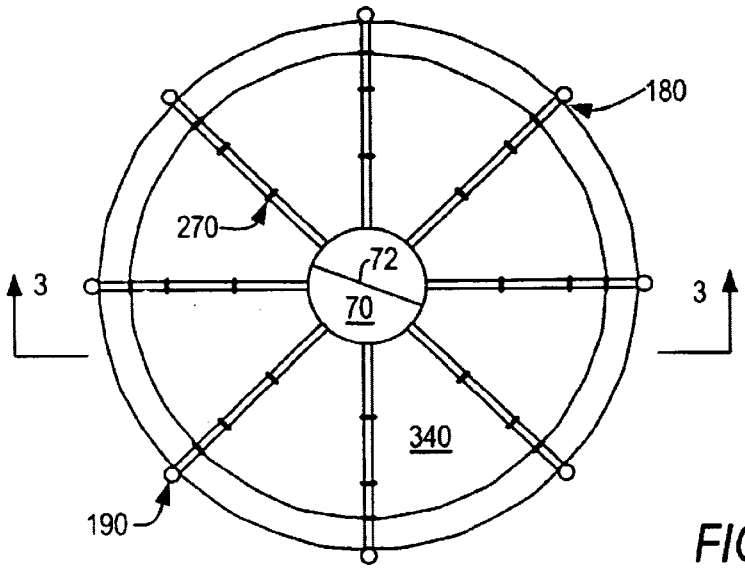
FIG. 1 is a top view of the umbrella and its transport system with the umbrella canopy open.
Figure 2:
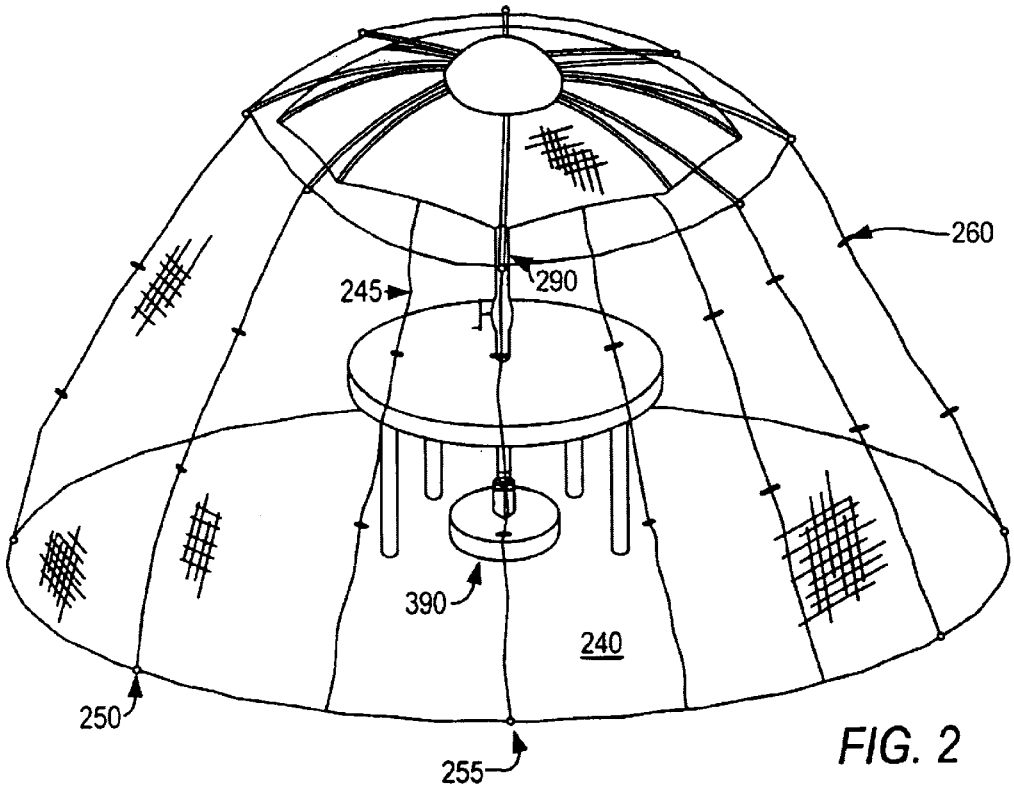
FIG. 2 is a perspective view showing the invention assembled with umbrella canopy open and canopeum fully deployed.

A typical embodiment of the invention is illustrated by SHEET 1, FIG. 1 (top view), FIG. 2 (perspective), and SHEET 2, FIG. 3 (section). The invention includes storage chamber 10, made of a plastic sufficiently rigid to support attached members. Chamber 10 rests above a 5.1 cm. (2 inch) outside diameter ("OD") by 1.83 m. (6 ft.) plexiglass support 290 having 0.3 cm. (⅛ inch) thick walls. Support 290 is available from Industrial Plastics, of New York, N.Y. The disclosed invention also includes eight fiberglass transport tubes 180. Transport tubes 180 are each 107 cm. (3 ft. 6 in.) long with 0.54 cm. (¼ inch) diameters, available from Max-Gain-Systems, Inc., Marietta Ga. Components of the present embodiment generally are comprised of materials having low coefficients of electrical conductivity. This reduces potential danger from lightning strikes.

Cooperating Members

FIG. 1, FIG. 2, and FIG. 3 illustrate several cooperating members seen in prior art of umbrellas. These members include umbrella support 290, and umbrella stand 390. Also cooperating are canopy 340, canopy ribs 350, and rib pivots 360. Supporting these members are rib supports 370, and support mounted rib slide collar 380.

In order to cooperate with a typical embodiment of the present invention, a number of standard umbrella members have been modified. For example, canopy ribs 350 made of pine are used to extend and support umbrella canopy 340. Canopy ribs 350 are connected to rib pivots 360 located around the periphery of storage chamber 10. This differs from the usual form of traditional umbrellas. In prior art of umbrella construction canopy ribs generally attach to pivots located at a small hub above the umbrella support.

Storage Chamber Components

SHEET 3, FIG. 4 illustrates storage chamber 10 and the upper portion of umbrella support 290. In a typical embodiment of the present invention, chamber 10 and support 290 serve as storage sites for canopeum 240 and members of its transport system. Chamber 10 dimensions are predicated by the size of canopeum 240. In the present embodiment, chamber 10 is tulip shaped with circular cross section. Chamber 10 has an upper diameter of 35.5 cm. (14 inches), diminishing to a diameter of 5.1 cm. (two inches) where it connects with support 290. The height of chamber 10 is 47 cm. (18 inches). Chamber support transition piece 20 reinforces the union between chamber 10 and umbrella support 290.

Each of eight transport tubes 180 passes through a 1.27 cm. (0.5 inch) inside diameter ("ID") by 5.1 cm. (2 inch) alignment guide 30. Each alignment guide 30 is connected to a guide linkage 40. Guide linkages 40 in turn are attached to 25.4 cm. (ten inch) long linkage track rods 50 evenly spaced around the interior of chamber 10. Each linkage track rod 50 is attached to the interior wall of chamber 10 adjacent to a canopy rib 350. Serrated crown 60 contains eight valleys, each centered above a canopy rib 350. When canopeum 240 is fully deployed, one transport tube 180 rests in each of valley. Transport tubes 180 act as cantilevers, extending radially outward over canopy 340.

Transport tubes 180 each join 5.1 cm. (two inch) long, hollow rubber, safety tips 190. Each safety tip 190 terminates at a perforated 1.9 cm. (0.75 inch) diameter sphere from which retractor strings 210 emerge. Relative flexibility of safety tips 190 helps avoid possible injury resulting from accidental contact with transport tubes 180. Safety tips 190 also enhance the ability of transport tubes 180 to articulate with septums 65 and alignment guides 30, near the base of chamber 10.

When the canopeum transport system in its fully retracted configuration, tips of transport tubes 180 congregate around the base of the storage chamber 10. When fully retracted, segments of canopeum 240 wrap around peaks in chamber 10's crown, then extend downward towards transport tubes 180 at the bottom of chamber 10.

Thin, stiff plastic sheets form septums 65, radially dividing the interior of storage chamber 10 into eight compartments. Each septum 65 is secured to the interior wall of chamber 10. Septums are connected to chamber 10 at midpoints of peaks in the serrated crown. Transport tubes 180 are guided through each of the resulting storage chamber segments.

The surface of chamber 10 contains a multitude of perforations 15 having diameters of approximately ⅛ inch. Perforations 15 allow incidental moisture to exit the chamber. Perforations 15 also allow fresh air to enter and circulate, preventing mildew forming on canopeum 240 while it is stowed. end.

Chamber Cover

SHEET 3, FIG. 4 illustrates cover 70 that shields and protects contents of storage chamber 10. In the present embodiment, cover 70 has the form of a flexible, segmented, plastic shell. A seam in cover 70 is rests on cover support frame 80 directly above a pair of septums 65. Cover 70 has a diameter of 40.6 cm. (16 inches) extending 5.1 cm. (two inches) beyond the periphery of serrated crown 60 of chamber 10. Cover 70 is divided diametrically into two halves, joined along their seam by cover flexible union 72. Cover support 100 extends upwards from two cover support anchors 90 located on the crest of chamber 10. Cover support frame 80 arches above chamber 10 where its transverse member coincides with the flexible seam joining both halves of cover 70. Cover 70 is fitted with cover clips 75 that may be attached to corresponding cover clip anchors 76 on chamber 10.

Transport Members

The present embodiment's transport system includes transport cylinder 130 illustrated in FIG. 4 and FIG. 5. transport cylinder 130 comprises a 24" length 1¾" O.D. poly vinyl chloride (PVC) pipe. It is mounted within umbrella support 290. Three longitudinal transport cylinder keys 200, fastened to the exterior of transport cylinder 130, mate with vertical support keyways 300 placed inside umbrella support tube 290.

Illustrated in FIG. 4, FIG. 5, FIG. 6, FIG. 7, FIG. 8 and FIG. 9, lengths of flexible plastic tube 160, 5.1 cm. (two inches) long and 0.64 cm. (¼ inch) outside diameter serve as connections. They join and permit articulation between transport tubes 180 and transport cylinder 130. One end of each flexible plastic tube 160 is force fit onto a transport tube 180. The opposite ends of flexible plastic tubes 160 are force fit onto 0.64 cm. (¼ inch) by 2.54 cm. (one inch) threaded, hollow, attachment tubes 150. Attachment tubes 150 are placed in eight threaded holes arrayed in a circular pattern through 4.45 cm. (1.75) inch diameter brass transport cylinder attachment 140. It, in turn, is connected to the upper end of transport cylinder 130.

Each flexible plastic tube 160 contains a 0.32 cm. (⅛ inch) by 2.54 cm. (one inch) long steel spring stiffener 170 that serves as a stent. Spring stiffeners 170 prevent pinching of retractor strings 210 that extend longitudinally through transport system members including flexible plastic tubes 160.

Each retractor string 210 passes through transport tubes 180, canopeum wall rings 260, then attach to canopeum base rings 250 at the bottom margin of canopeum 240. The other end of each retractor string 210 passes through transport cylinder 130, down support 290, then through retractor string pulleys 220 at the base of the umbrella support 290. Next, strings 210 pass upwards through support 290, through retractor string access port 310 and enter crank, gear, reel assembly 330 mounted on umbrella support tube 390.

The crank of crank, gear, reel assembly 330 connects, via gear trains, with two counter-rotating take-up reels. Each reel's rate of rotation is proportional to the length of the deployment cord 230 compared to the length of retractor strings 210. Use of two reels allows one crank to independently wind unequal lengths of flexible members. A single crank mechanism 330, can thereby both deploy and retract canopeum 240.

Near the base of storage chamber 10 is a set of two deployer cord pulleys 110 through which pass deployer cord 230 connected at one end to the base of transport cylinder 130 and at its other end connected to a reel in crank, gear, reel assembly 330.

Canopeum Members

Canopeum 240 contains netting, style "DURP 50", from Apex Mills Corporation, Inwood, N.Y. Canopeum 240 is equipped with several attachments, canopeum base ring 250, canopeum wall ring 260, and canopeum transport tube ring 270. These three types of rings may be opened and closed to facilitate replacement of canopeum 240. Canopeum transport tube rings 270 connect each transport tube 180 to canopeum 240. Canopeum transport tube rings 270 facilitate gathering upper portions of canopeum 240 into chamber 10. These rings allow canopeum 240 to slide evenly along transport tubes 180 when the latter are raised or lowered.

Canopeum storage chamber fasteners 280 are distributed along the upper edge of canopeum 240. These members facilitate discretionary attachment, detachment, and interchange of canopeums of various constructions. They also support occasional canopeum removal for cleaning. Canopeum zippers 245 facilitate opening a portal into, and the interchange of, canopeum 240. Ground fasteners 255 provide a way to extend the base of canopeum 240, and securing it to the ground. These fasteners have the form of elongated spikes, able to penetrate and provide anchorage in soil. Alternately, ground fasteners 255 can connect to anchors or weights independent of the present system.

Operation

Canopeum Deployment

Deploying canopeum 240 of the invention's present embodiment is accomplished simply by turning crank, gear, and reel assembly 330. Force is thereby applied to deployment cord 230. Deployment cord 230 transmits this force along its length through deployment cord access port 320 in umbrella support 290. Ultimately the force is relayed, via deployer cord pulleys 110, to the base of transport cylinder 130, where one end of deployment cord 230 is attached.

Winding deployment cord 230 lifts transport cylinder 130 and its eight attached transport tubes 180. Transport cylinder keys 200 and support tube keyways 300 impede rotation of the transport cylinder 130 and its attachments around the longitudinal axis of umbrella support tube 290. As continuing force is applied to crank, gear, and reel assembly 330, transport tubes 180, connected with transport cylinder 130, emerge from umbrella support 390. Components of canopeum 240 are thereby projected from chamber 10.

During deployment, and later retraction operations, cover 70 is pushed and folded to allow canopeum 240 and transport mechanisms to exit, and later reenter, storage chamber 10. Cover clips 75 on the periphery of cover 70 may be attached to corresponding cover clip anchors 76 on storage chamber 10 in order to secure cover 70 in a closed position while the umbrella is being transported or stored.

As transport tubes 180 progressively emerge from umbrella support tube 290 they are directed by alignment guides 30. Alignment guides 30 are connected to guide linkages 40 that are free to slide along linkage tracks 50. Transport tubes 180 are thereby guided radially outward towards valleys in serrated crown 60's wall. Transport tubes 180 rotate from an initial near vertical orientation, passing through angles of approximately 110 degrees of arc before coming to rest in wall valleys of crown 60. As transport tubes 180 rotate, steel spring stiffeners 170 acting as stents prevent flexible plastic tubes 160 from pinching retractor strings 210. Retractor strings 210 thereby remain free to move, even when transport tubes 180 are fully deployed.

As transport cylinder 130 reaches its maximum extension from support 290, transport tubes 180 descend adjacent to corresponding umbrella ribs. Canopeum 240 material then overhangs the end of umbrella ribs 350 by about 7.6 cm. (three inches). Along each transport tube 180 two rings attach to the upper portion of canopeum 240. This facilitates gathering segments of canopeum 240 that rest on umbrella canopy 340. These connections allow canopeum 240 to cling to transport tubes 180 as the latter are moved. Canopeum chamber fasteners 280 distributed along the upper edge of the canopeum 240 and outer periphery of the storage chamber 10 facilitate interchange of canopeums 240 having various constructions, textures, and surface details, as well as periodic cleaning of canopeum 240 material.

When canopeum 240 is fully deployed the valleys in serrated crown 60 help keep transport tubes 180 aligned, above canopy ribs 350. Valley surfaces support and act as fulcrums for transport tubes 180 as they alternately rotate, translate, and slide, transporting, then suspending canopeum 240.

Having been projected beyond the periphery of canopy ribs 350 enclosure material of canopeum 240 is drawn downwards by gravity. It is restrained only by retractor strings 210 attached to its fabric. Additional clockwise rotation of crank, gear, reel assembly 330 allows canopeum 240 to descend towards the ground. Canopeum ground fasteners 255 can alternately be inserted into soil and also attached to ground based links. Use of canopeum ground fasteners 255 facilitate an outwardly tapered configuration for canopeum 240, thereby providing a larger footprint for additional usable space beneath the enclosure.

Canopeum Retraction

Return of canopeum 240 to storage chamber 10 is accomplished by turning crank, gear, reel assembly 330 in a counterclockwise direction. The crank is connected via trains of gears to two counter rotating reels, also mounted on umbrella support tube 290. The rate of rotation of one reel is proportional to the functional length of deployment cord 320 and the second reel to the length of retractor strings 210. Therefore, turning a single crank enables both deployment from, and return to, chamber 10 by canopeum 240. This arrangement also insures that adequate tension is maintained on retractor strings 210 and deployment cord 230, avoiding possible entanglements.

Counterclockwise rotation of the crank reduces tension on the deployment cord 230 while simultaneously applying force to retractor strings 210. Force applied to strings 210 initially draws canopeum 240 upwards as strings 210 retreat in through transport tubes 180. At the bottom of umbrella support tube 290 each retractor string 210 passes around an individual retractor string pulley 220. A battery of eight retractor string pulleys 220 reduces inter-string friction, allowing easier movement of canopeum 10. Extending upwards, strings 210 pass through a small retractor string access port 310 in the wall of umbrella support tube 290. Retractor strings 210 then wind on a reel, part of crank, gear, reel assembly 330.

When canopeum 240 is gathered as far as possible at the tips of transport tube 180, winding forces transfer to transport tubes 180. Subsequently, canopeum 240, transport tubes 180 and transport cylinder 130 are forced to retreat to stowed positions at chamber 10 and umbrella support tube 390.

Above chamber 10, cover 70 shields and protects contents of the chamber. During deployment and retraction phases of the invention's operation, cover 70 is displaced, rising and folding on support frame 80. Frame 80 is mounted on two crests of serrated crown 60 attached to cover support anchors 90. Canopeum 240 and transport tubes 180 displace cover 70 when they enter and leave chamber 10. Cover 70 is composed of plastic having sufficient flexibility so it can be folded. Cover 70 is also sufficiently heavy so it drops to its original location when displacing forces are removed. When the umbrella is being transported and while in storage cover clips 75 and cover clip anchors 76 may be used to secure cover 70 in its closed position.

Advantages of the Present Invention

From the description above, advantages of our enclosure storage and deployment system become evident:

(a) At a time when mosquitoes and other insects can be a considerable health hazard as well as nuisance, the present invention provides an easy to manage protective enclosure of netting, canopeum 240, that significantly enhances the value of outdoor shelters such as umbrellas.

(b) The invention provides protected storage chamber 10, an integral part of the umbrella, in which canopeum 240 can be conveniently stowed while not in service. Existing nets for the enclosure of umbrellas lack these features.

(b) It permits umbrella canopy ribs 350 to be attached to storage chamber 10 providing an opening above the container of sufficient dimensions to facilitate storage, deployment, and retraction of the protective material;

(c) It permits canopeum 240 to be conveniently extended, retracted, and stowed by use of a crank mechanism.

(d) It facilitates temporary and permanent replacement of canopeum 240.

Summary, Ramifications, and Scope

Accordingly, the reader will see that this invention, when integrated with various types of umbrellas, or structures such as tents and canopies serves to deploy, retract, and conveniently store protective canopeum enclosures, without having to detach and remove this canopeum from the primary structure. The invention's storage chamber provides its stowed canopeum with a readily accessible sanctuary, protected from excessive damage and soiling. Furthermore, the present embodiment of the invention has additional advantages in that:

It provides a storage chamber, conveniently centered above the umbrella's support, in which the canopeum of protective material may be secured while not in service.

it permits the umbrella's canopy ribs to be attached to the storage chamber. This arrangement allows for an opening above the chamber having sufficient dimensions to facilitate storage, deployment, and return of the canopeum;

it provides a set of members which project canopeum material from the storage area, then transport the protective material beyond the edge of the umbrella's canopy, where it can be further extended to the ground;

it permits the canopeum to be transported by an easily accessed crank;

Although the description above contains many specificities, these should not be construed as limiting the scope of the invention but as merely providing illustrations of some of the present embodiments of this invention. For example, all dimensions can vary, the storage container can have other shapes, such as cylindrical, conical, hemispheric, with other cross-sectional shapes such as circular, oval, trapezoidal, triangular, etc.; guide tubes and septums may have various dimensions and manifestations, transport tubes may have other cross-sectional shapes, flexible tube connections for linking transport tubes to the transport cylinder can be replaced by other types of connection which also enable transport tubes to move from a vertical position, while they move the canopeum outward beyond the periphery of the umbrella canopy.

In addition, transport cylinder, transport tubes, storage chamber, cover, and canopeum may be composed of alternate materials. The transport cylinder, transport tubes, and canopeum may be brought to their deployed and retracted positions by an alternate method, rather than a manually operated crank, such as a cord pulled by motor, alternate gear or pulley combinations, or by way of a slide mechanism. Alternate devices may be used for attachment, removal, and interchange of canopeums having assorted compositions, textures, and surface details.

Although our enclosure storage and deployment system functions with a variety of components seen in the prior art, it does not necessarily require all of these. For example, the invention can operate without standard umbrella canopy and ribs. Provided with a support, a canopeum along with our storage and deployment system will provide its own shelter.

Each part indicated above may also find a useful application in other types of structure differing from those described.

The present invention has been illustrated as embodied in an umbrella but it is not limited to that embodiment, because various omissions, and changes in the shapes and specifics of the illustrated invention, and its operation, can be made without altering the fundamental character of the invention. The description of this invention has been made for purposes of revealing a particularly useful embodiment. It is not intended to limit the invention to only the disclosed form.

The scope of the invention should be determined by the appended claims and their legal equivalents, rather than by the examples given.

We claim:

1. An umbrella structure comprising:

(a) a canopy and a canopy support frame, (b) a canopeum providing means for substantially encompassing a plurality of humans, (b) a storage chamber providing means for substantially containing said canopeum, said storage chamber also providing means for bearing said canopy support frame, (c) a hollow support providing means for bearing other components of said umbrella structure, (d) a plurality of elongated elements providing means for urging said canopeum relative to said storage chamber.

2. An umbrella structure comprising:

(a) a canopy and a canopy support frame, (b) a canopeum providing means for substantially encompassing a plurality of humans, (b) storage chamber providing means for substantially containing said canopeum, said storage chamber also providing means for bearing components of said canopy support frame and said canopy, (c) a hollow support providing means for bearing said umbrella structure, (d) a plurality of transport elements including a hollow stem, a plurality of articulated elongated members and a plurality of flexible elongated members, said transport elements providing means for urging said canopeum relative to said storage chamber thereby expanding and contracting said canopeum.

3. The umbrella structure of claim 2, wherein said hollow support and said storage chamber contain a plurality of guiding elements providing means for articulating said transport elements.

4. The umbrella structure of claim 3, wherein said plurality of articulated elongated members are individually joined to said hollow stem by a plurality of couplings providing means for facilitating movements of said articulated members.

5. The umbrella structure of claim 4, wherein said hollow support and said storage chamber have sufficient size to provide means for containing said transport elements.

6. The umbrella structure of claim 5, wherein said flexible elongated members provide means for transmitting force to said hollow stem, said articulated elongated members, and said canopeum, urging them to move relative to said storage chamber, whereby said canopeum may be deployed and retracted.

7. The umbrella structure of claim 6, wherein a multitude of fasteners provide means for attaching said canopeum to said transport elements, said fasteners also providing means for interchanging canopeums.

8. The umbrella structure of claim 7, wherein a cover mounted at said storage chamber provides means for protecting contents of said storage chamber, said cover allowing said transport elements and said canopeum to enter and leave said storage chamber.

9. An umbrella structure comprising:

(a) a canopy and a canopy support frame, (b) a canopeum having expanded, retracted, and intermediate configurations, said canopeum being composed of materials including mosquito netting, said canopeum substantially hemispheric in shape, said canopeum having sufficient size when expanded to encompass a plurality of humans, (b) a storage chamber of sufficient size to substantially contain said canopeum, said storage chamber having two diametrically opposed orifices of sufficient size to allow passage of said canopeum, said storage chamber having a plurality of attachment anchorages for a plurality of said canopy support frame components, (c) a hollow support attached at one orifice of said storage chamber, said hollow support having sufficient size and strength to bear said umbrella structure, (d) a plurality of transport elements comprising a plurality of articulated elongated members individually attached to one end of a hollow stem, said transport elements also including a plurality of flexible elongated members passing through said hollow stem and said plurality of articulated elongated members, said flexible elongated members connected at one end with said canopeum, said transport elements having sizes allowing their containment within said hollow support and storage chamber, said transport elements allowing said canopeum to remain substantially within said storage chamber while said canopy is in either open or closed positions, (e) a multitude of fasteners for attaching said canopeum to said transport elements, said fasteners having the ability to open and close thereby facilitating removal, replacement, or interchanging varied manifestations of said canopeums.

10. The umbrella structure of claim 9, wherein said plurality of articulated elongated members are connected to said hollow stem by a plurality of couplings, said couplings having flexible form, allowing the rotation of said articulated elongated members in an array of planes, said planes extending radially from, and parallel, to, the major axis of said hollow stem.

11. The umbrella structure of claim 10, wherein a plurality of tracks, linkages, and slides guides facilitate orderly movements of said transport elements, the interior of said chamber containing a plurality of said tracks and linkages.

12. The umbrella structure of claim 11, wherein said tracks are connected by said linkages to said slides located on said articulated elongated members, the sizes and composition of said slides allowing said slides to move concurrently with said articulated elongated members between limits imposed by the lengths of said tracks, said linkages thereby serving to collimate and rotate said articulated elongated members between positions parallel to said hollow stem and symmetrically distributed radial orientations, achieved after rotations of said articulated elongated members through angles up to 120 degrees of arc.

13. The umbrella structure of claim 12, wherein said flexible elongated members pass through said hollow support, said hollow stem, and said articulated elongated members, additionally, said hollow stem is prevented from rotating relative to said hollow support by an elongated key and keyway system extending along the exterior surface of said hollow stem and the interior surface of said hollow support.

14. The umbrella structure of claim 13, wherein is contained a plurality of simple machines including a plurality of pulleys mounted on said hollow support, said simple machines also including a plurality of motive devices able to yield mechanical advantage to urging forces applied to said flexible elongated members.

15. The umbrella structure of claim 14, wherein the wall of said storage chamber contains a series of undulations of sufficient size to allow individual placement of said articulated elongated members, thereby providing increased resistance substantially counteracting lateral forces having the potential for disrupting symmetrical deployment of said articulated elongated members and said canopeum.

16. The umbrella of claim 15, wherein a cover is attached at one orifice of said chamber with sufficient degrees of freedom to allow substantial shielding of said canopeumn while retracted, as well as facilitating extension and retraction of said canopeum.

17. The umbrella of claim 16, wherein said chamber contains a network of septums extending from the interior surface of said chamber, said septums providing additional capability for guiding said articulated elongated members and said canopeum.

* * * * *